US009463852B2

(12) United States Patent
Fairfield et al.

(10) Patent No.: US 9,463,852 B2
(45) Date of Patent: Oct. 11, 2016

(54) APPARATUS AND METHOD FOR NEUTRALIZING UNDERWATER MINES

(71) Applicant: LOCKHEED MARTIN CORPORATION, Bethesda, MD (US)

(72) Inventors: Scott W. Fairfield, Canastota, NY (US); Kerry D. Laviolette, Liverpool, NY (US); Donald J. Robertson, Manlius, NY (US); Ronald D. Zamojski, Skaneateles, NY (US); Gary L. Wiedemeier, North Syracuse, NY (US); Joseph M. Cuschieri, Boca Raton, FL (US); Christopher E. Marchant, Baldwinsville, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 14/990,205

(22) Filed: Jan. 7, 2016

(65) Prior Publication Data

US 2016/0200409 A1 Jul. 14, 2016

Related U.S. Application Data

(62) Division of application No. 13/840,223, filed on Mar. 15, 2013, now Pat. No. 9,260,168.

(60) Provisional application No. 61/612,024, filed on Mar. 16, 2012.

(51) Int. Cl.

| | |
|---|---|
| ***B63G 7/02*** | (2006.01) |
| ***B63G 8/28*** | (2006.01) |
| ***B63G 9/00*** | (2006.01) |
| ***B63B 22/00*** | (2006.01) |
| ***B63G 8/00*** | (2006.01) |
| *B63G 7/00* | (2006.01) |

(52) U.S. Cl.

CPC ..... *B63G 7/02* (2013.01); *B63B 22/00* (2013.01); *B63G 8/001* (2013.01); *B63G 2007/005* (2013.01); *B63G 2008/002* (2013.01)

(58) Field of Classification Search

CPC ..... B63G 7/02; B63G 8/28; B63G 9/00; F42B 22/42; F42B 19/00

USPC ..... 89/1.13; 102/402, 403; 114/21.1, 21.2

See application file for complete search history.

(56) References Cited

U.S. PATENT DOCUMENTS

| | | | |
|---|---|---|---|
| 3,303,945 | A | 2/1967 | Hubbard et al. |
| 3,993,011 | A | 11/1976 | Garland |
| 5,686,686 | A | 11/1997 | Woodall et al. |
| 6,244,912 | B1 | 6/2001 | Quadrini et al. |
| 6,390,012 | B1 | 5/2002 | Watt et al. |
| 6,738,314 | B1 | 5/2004 | Teeter et al. |
| 6,846,210 | B1 | 1/2005 | Abella |
| 7,371,139 | B1 | 5/2008 | Abella |
| 7,398,741 | B2 | 7/2008 | Koda et al. |
| 2011/0292760 | A1 | 12/2011 | Hayes |
| 2013/0239869 | A1 | 9/2013 | Hesse et al. |

FOREIGN PATENT DOCUMENTS

| | | |
|---|---|---|
| EP | 1602574 | 12/2005 |

*Primary Examiner* — Jonathan C Weber

(74) *Attorney, Agent, or Firm* — Hamre, Schumann, Mueller & Larson, P.C.

(57) ABSTRACT

A mine neutralizing device that includes a buoy. The buoy includes a mine neutralizing device capable of swimming to an undersea mine to neutralize it. A method for neutralizing undersea mines includes locating an undersea mine, placing a buoy containing a mine neutralizer near the mine, and swimming the mine neutralizer to the undersea mine.

9 Claims, 18 Drawing Sheets

APPARATUS AND METHOD FOR NEUTRALIZING UNDERWATER MINES

TECHNICAL FIELD

Various embodiments described herein relate to a system and method for neutralization of underwater mines. More particularly, this invention relates to a method and device for deploying one or more sea mine neutralizers attached to buoys. The sea mine neutralizers are released from the buoys and directed to the mine to neutralize the mine.

BACKGROUND

Undersea mines are a constant threat in wartime. Undersea mines are also a threat during peace time. The threat of mines presents a destabilizing concern. For example, countries have recently threatened to blockade the Straits of Hormuz which is one of the few seaways in the Middle East. This is a major seaway and its blockade would have disrupted shipping around the globe. Mines could very well be a part of the strategy to blockade any waterway. Ships would avoid the waterway as it would not be worth the risk of losing a very expensive ship in the process.

There must be a system or method to deal with the threats to shipping and naval operations caused by mines. In certain situations, mines must be located and eliminated to allow effective operations and prevent losses. In the past contact and influence mines have caused significant amounts of damage to ships. In particular, mines have proven so effective because they are relatively inexpensive to build and deploy, and are extremely difficult to detect, classify, identify and neutralize. Current mine neutralization strategies are inadequate. Traditionally, mines have been defeated by deploying search vessels to locate them, and by controlling the radiated signatures of various ships, such as naval ships. The problem with these techniques is that they require additional systems, such as divers with explosives, or helicopters dragging sweep systems along with separate monitoring facilities that require substantial time and logistic resources to implement. In some instances, a surface mine countermeasures ship is used to search for and detect mines and then to launch and direct a mine neutralizer to destroy an undersea mine. The surface ship may be placed in harm's way since it is in or near the mine field and near enemy ships that may be patrolling the area. Helicopters also have the same disadvantage and more. Helicopters are expensive to operate and are incapable of stealthy operations. In addition, helicopters have a limited operational time due to fuel load that can be handled by the helicopter. This also results in less efficient operations as more separate runs are needed to find mines and neutralize them.

SUMMARY OF THE INVENTION

A mine neutralizing device that includes a buoy. The buoy includes a mine neutralizing device capable of swimming to an undersea mine to neutralize it. A method for neutralizing undersea mines includes locating an undersea mine, placing a buoy containing a mine neutralizer near the mine, and swimming the mine neutralizer to the undersea mine where it explodes to destroy the mine. In one embodiment, a remote multi-mission vehicle is remotely controlled in the water from a remote location. The remote multi-mission vehicle carries several mine neutralizing buoys. The remote multi-mission vehicle locates the mine and marks its location. The location is sent to a remote control station. At about the same time, a mine neutralizing buoy is deployed from the remote neutralizing vehicle. The buoy floats to the surface. The buoy also has an antenna and is capable of floating indefinitely, determining its location, and being controlled from a remote control station. Although a deployed neutralizing buoy will float indefinitely, the useful time is limited by the onboard battery life as the battery powers the operations of the buoy. When there is a plurality of undersea mines, a plurality of buoys are deployed over time. The remote multi-mission vehicle can be removed from the area so that it can be recovered and reused. The remote control station can then deploy one or more neutralizing devices from the mine neutralizing buoys to neutralize the undersea mines. This can all be done remotely and stealthily.

DETAILED DESCRIPTION

Figure 1:
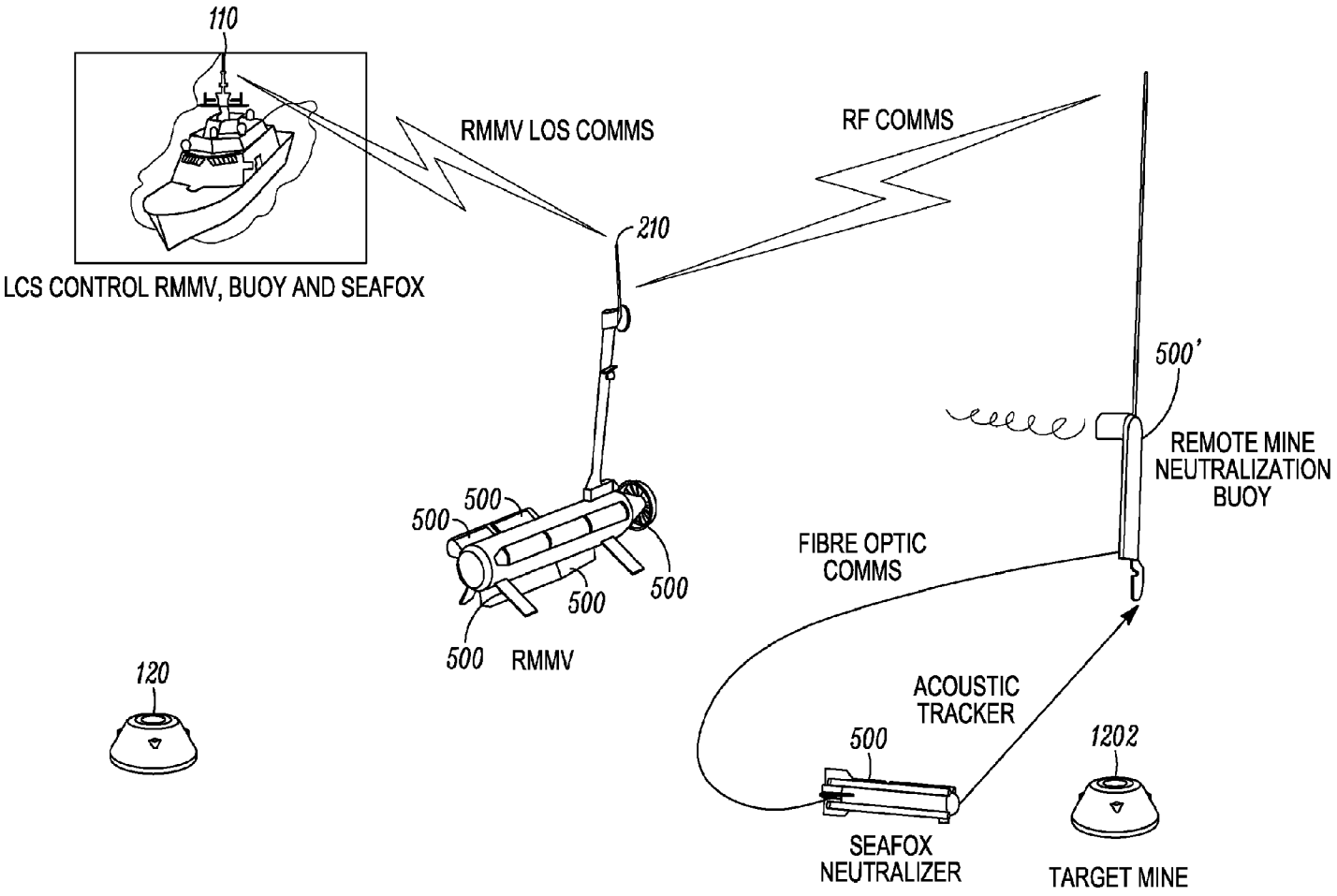
FIG. 1 is a schematic view of a system for undersea mine neutralization, according to an example embodiment.

FIG. 1 is a schematic view of a system 100 for undersea mine neutralization, according to an example embodiment. The system 100 includes a remote multi mission vehicle (RMMV) 200 that carries plurality of mine neutralizer buoys 500, a remote control station 110, and communication links between the remote mission vehicle 200 and the mine neutralizer buoys 500. The mine neutralizer buoys 500 include a mine neutralizer 800. The remote multi mission vehicle 200 is a remotely operated semi-submersible vehicle capable of different types of missions. Remote multi mission vehicle 200 is capable of locating undersea mines, such as undersea mine 120 and undersea mine 122. The remote multi mission vehicle 200 marks the location of the undersea mines 120, 122 using a global positioning system (GPS) or other similar system. The remote multi mission vehicle 200 includes an antenna 210 which is used to relay or communicate the location of the undersea mines 120, 122 to the remote control station 110. The remote multi mission vehicle 200 is also capable of deploying neutralizer buoys 500 near an undersea mine. As shown in FIG. 1, neutralizer buoy 500' has been deployed near undersea mine 122. The neutralizer buoy 500' is also in communication with the remote control station 110. From remote control station 110 the remote multi mission vehicle 200 and the neutralizer buoys 500 deployed. In addition, once deployed the mine neutralizer 800 can be controlled to leave the neutralizer buoy 500' and directed toward a target, such as the undersea mine 122. The mine neutralizer 800 strikes the undersea mine 122 and explodes to neutralize the mine. Advantageously, the remote multi mission vehicle 200 can be controlled remotely and can leave the vicinity of the undersea mines 120, 122 and continue its search for additional mines before the mine neutralizers 800 are deployed from mine neutralizer buoys, such as 500'. Leaving the vicinity of the mines being neutralized protects the remote multi mission vehicle 200 from the resulting explosion. The remote multi mission vehicle 200 is relatively small and less detectable. The mine neutralizer buoys, such as 500' are even smaller and thus less detectable than the remote multi mission vehicle 200. As a result the system 100 operates in a stealthy manner, is economical, and safe to operate since operations are carried out remotely from the remote control station 110.

Figure 2B:
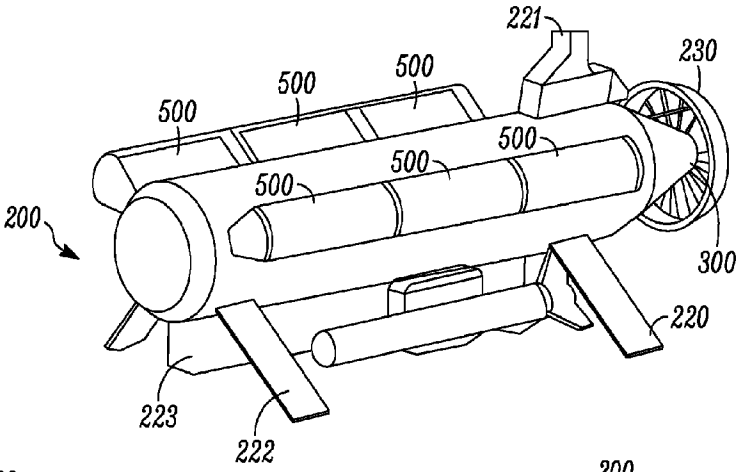
FIG. 2B is a perspective view of a remote multi mission vehicle (RMMV) loaded with mine neutralizer buoys, according to an example embodiment.
Figure 2C:
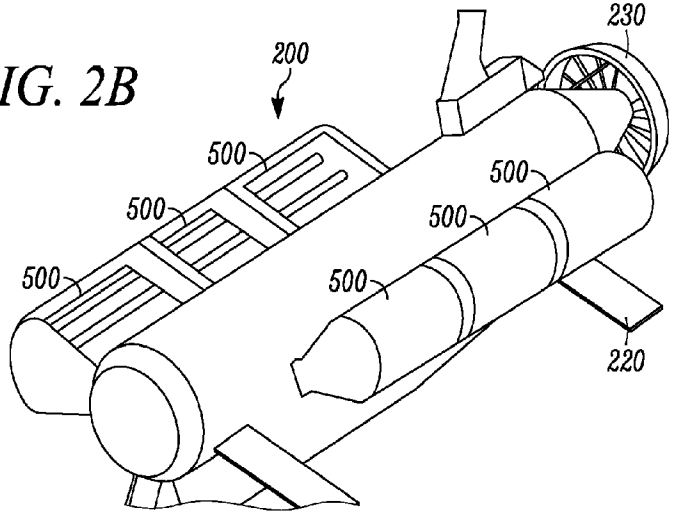
FIG. 2C is a perspective view of a remote multi mission vehicle (RMMV) loaded with mine neutralizer buoys, according to an example embodiment.
Figure 2A:
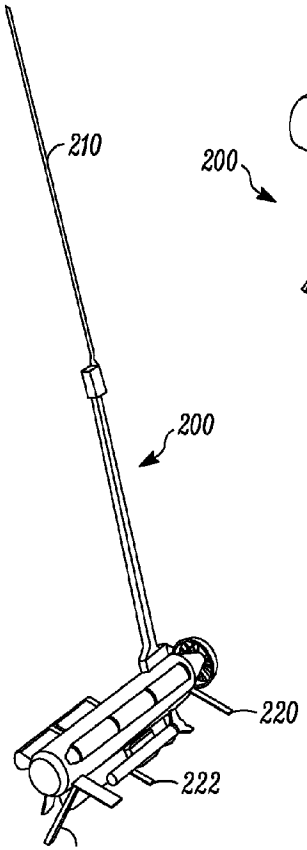
FIG. 2A is a perspective view of a remote multi mission vehicle (RMMV) loaded with mine neutralizer buoys, according to an example embodiment.

FIGS. 2A-2C are various perspective views of a remote multi mission vehicle (RMMV) 200 loaded with mine neutralizer buoys 500, according to an example embodiments. The remote multi mission vehicle 200 is used as a launching platform for the mine neutralizing system 100. It is contemplated that other launching platforms could be used. Now referring to FIGS. 2A-2C the portions of the RMMV 200 will be further detailed. The remote multi mission vehicle 200 includes various stabilizers 220, 221, 222, and 223. The remote mission vehicle 200 also includes a propulsion unit 230. The remote mission vehicle 200 also includes a plurality of encased mine neutralizing buoys 500. The remote mission vehicle 200 includes a rail system 300. The mine neutralizing buoys 500 are carried or temporarily attached to the rail system 300. As shown in FIGS. 2A, 2B and 2C six mine neutralizing buoys 500 are transported by the remote the mission vehicle 200. As will be discussed in further detail below, the mine neutralizing buoys 500 can be deployed from the remote multi mission vehicle 200 under the control of the remote control station 110. More specifically, the mine neutralizing lease 500 can be controllably released from the rail system 300.

Figure 3A:
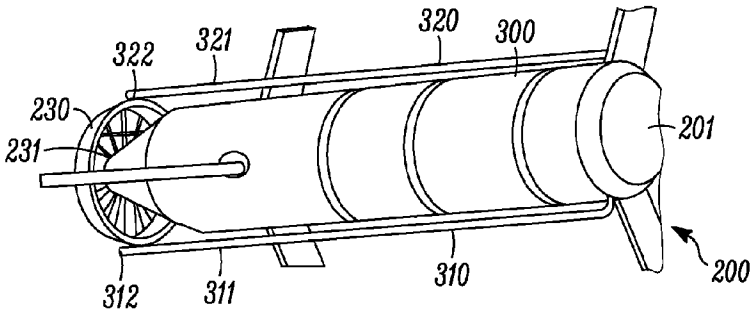
FIG. 3A is a perspective view of a remote multi mission vehicle (RMMV) with the mine neutralizer buoys removed to reveal rails, according to an example embodiment.
Figure 3B:
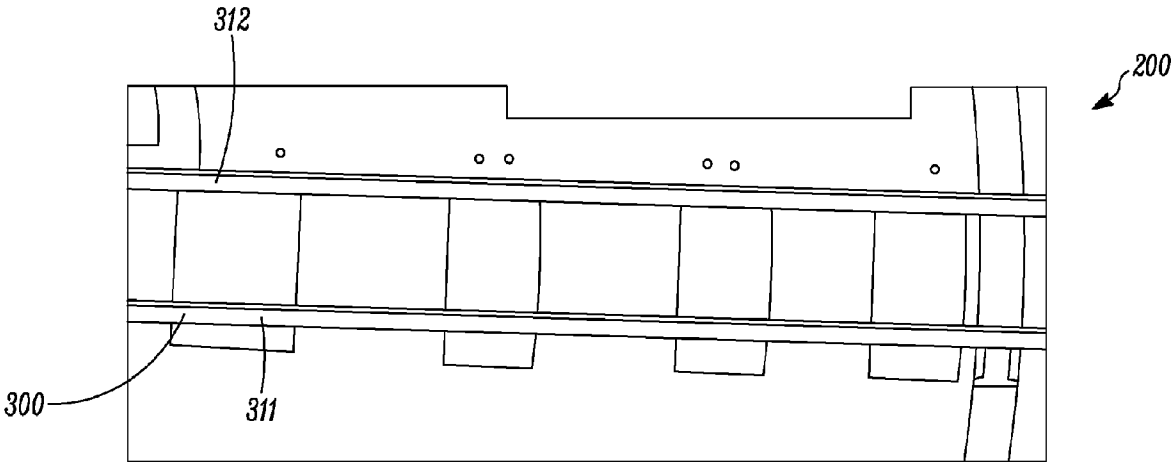
FIG. 3B is a side view of a remote multi mission vehicle (RMMV) with the mine neutralizer buoys removed to reveal rails, according to an example embodiment.

FIG. 3A is a perspective view of a remote multi mission vehicle (RMMV) 200 with the mine neutralizer buoys removed to reveal rails or rail system 300, according to an example embodiment. FIG. 3B is a side view of a remote multi mission vehicle (RMMV) with the mine neutralizer buoys removed to reveal rails, according to an example embodiment. Now referring to both FIGS. 3A and 3B, the rail system 300 of the remote multi mission vehicle 200 will be further detailed. The rail system 300 includes a first set of rails 310 and the second set of rails 320. The first set of rails includes rails 311 and 312. The second set of rails 320 includes rails 321 322. The remote mission vehicle 200 includes a front or bow 201. A propulsion system 230 is encased by a shroud 231 at the stern or rear of the remote mission vehicle 200. The rail system 300 extends substantially along the length of the remote mission vehicle 200. The rails extend from a position near the bow 201 to the shroud 231. The rails 311, 312, 321 and 322 are held to the remote multi mission vehicle 200 using existing bolt holes where possible. Of course additional support holes may be needed and made to support the rail system 300. The rails 311, 312, 321, 322 include slots for receiving wheels. The wheels operate within the slots of the rails 311, 312, 321, 322. The slots are large enough so that the wheels rotate freely yet are spaced to capture the wheels so they can be held by the rails 311, 312, 321, 322.

Figure 4:
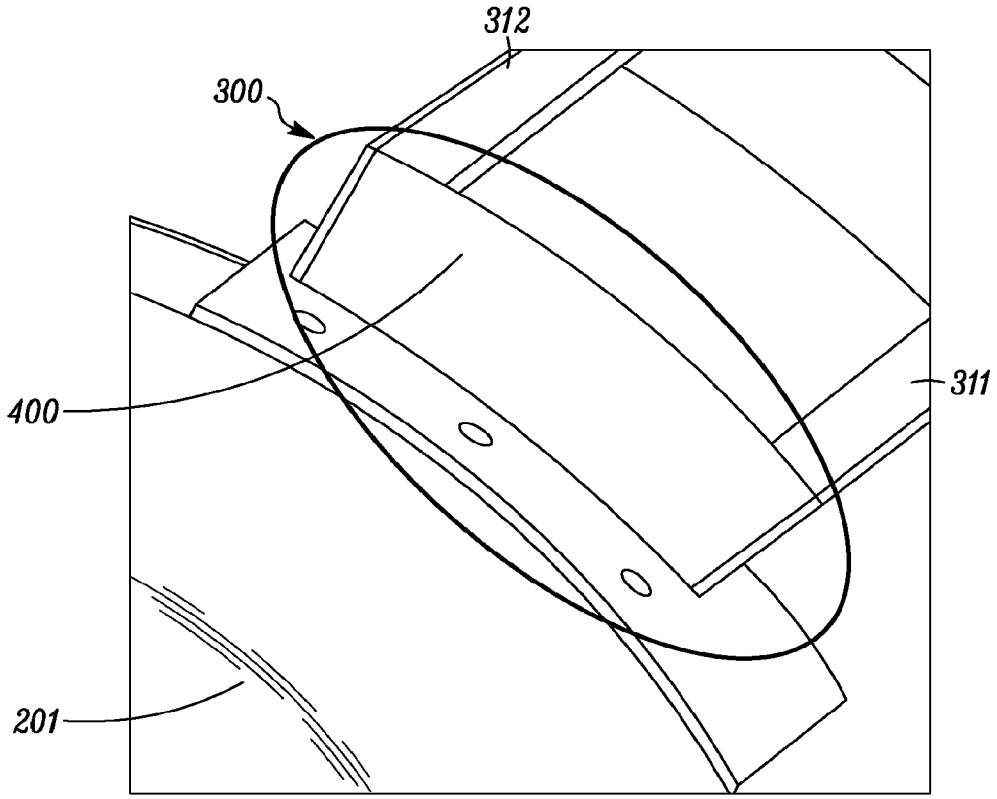
FIG. 4 is a perspective view of the front portion of the rails, according to an example embodiment.

FIG. 4 is a perspective view of the front portion of the rail system 300, according to an example embodiment. The front portion of the rail system 300 includes a stop 400. The stop 400 is shown as installed on rail 311 and 312 in FIG. 4. The stop 400 is attached to the rail 311 and to the rail 312. The stop 400 prevents wheels associated with the mine neutralizing buoys 500 (shown in FIGS. 2A-2C) from leaving the slots in the rails 311, 312. The stop also prevents the mine neutralizing buoy from moving forward of the stop 400. In other words, the stop 400 is dimensioned to engage a surface of the mine neutralizing buoys 500 so as to prevent the mine neutralizing buoys 500 from exiting the forward portion of the rail system 300.

Figure 5B:
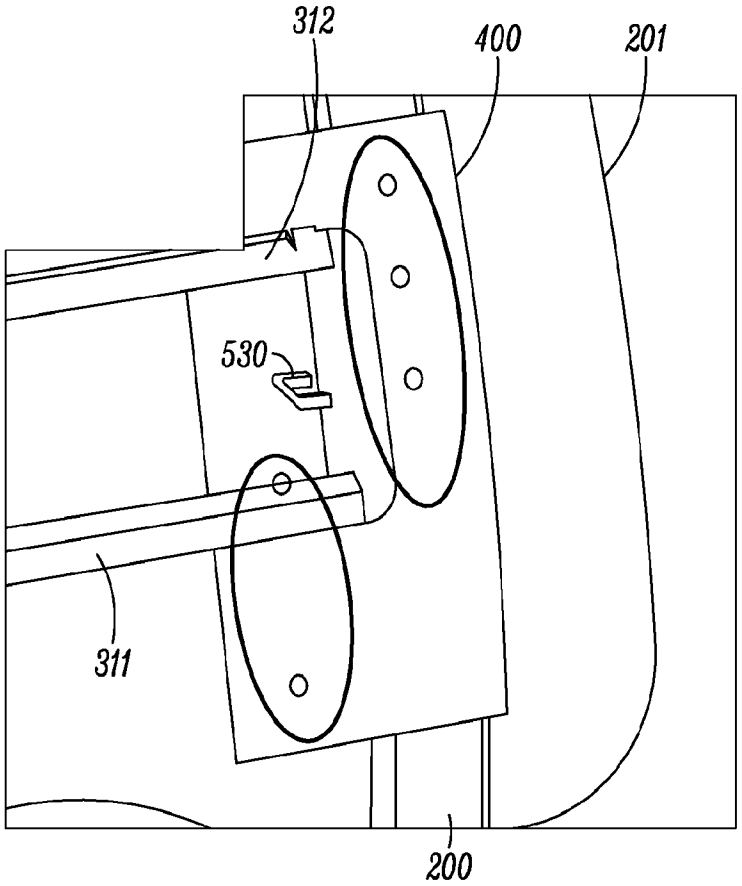
FIG. 5B is a perspective view of a hook positioned near the front portion of the rails, according to an example embodiment.
Figure 5A:
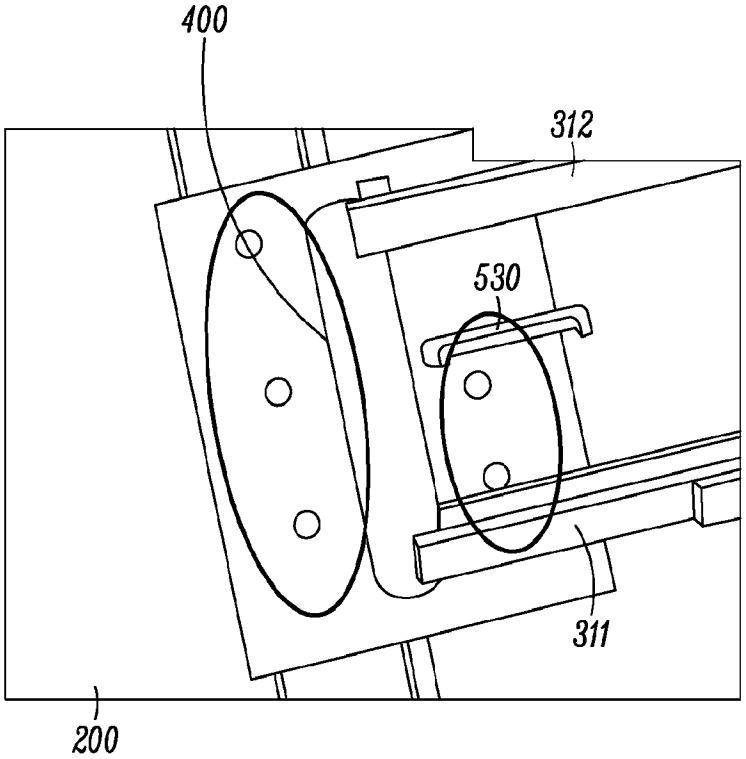
FIG. 5A is a perspective view of a hook positioned near the front portion of the rails, according to an example embodiment.

FIGS. 5A-5B are perspective views of a hook 530 positioned near the rear portion of the rails, according to an example embodiment. Now referring to both FIGS. 5A and 5B the hook 530 of the rail system 300 will be further described. The hook 530 is positioned between the rails 311 and 312 of the rail system 300. The hook 530 captures the encased neutralizer buoy 500 near the front of the neutralizer buoy. In one embodiment of the invention, the hook 530 is positioned near the forward stop 400. In another embodiment of the invention, the hook 530 is positioned near the stern of the vessel or remote multi mission vehicle 200. In still another embodiment there is a hook 530 for each of the neutralizer buoys 500 attached to the rail system 300. In the embodiment with a hook 530 for each possible position of a buoy 500, the hook is positioned to latch the buoy near the front of each buoy. The hook is designed to hold the front of the buoy to the rails thereby keeping the buoy attached to the RMMV 200 until it is deployed. The neutralizer buoy 500 has an opening in a fairing the captures the door of the neutralizer buoy 500. When and a neutralizer buoy 500 is deployed from the remote multi mission vehicle 200, the hook 530 releases the buoy and also releases the door of the neutralizer buoy 500. A small electric motor or a hydraulic system can be used to actuate the hook and move it from a first position, such as shown in FIG. 5A, to a second position, such as shown in FIG. 5B. Is contemplated that any type of actuator can be used to move the hook 530 between the first position and the second position and vice versa. The hook 530 not only attaches the neutralizer buoy 500 to the rail system but also laches a door of the neutralizer buoy 500 through the fairing encasing the neutralizer buoy 500.

Figure 6A:
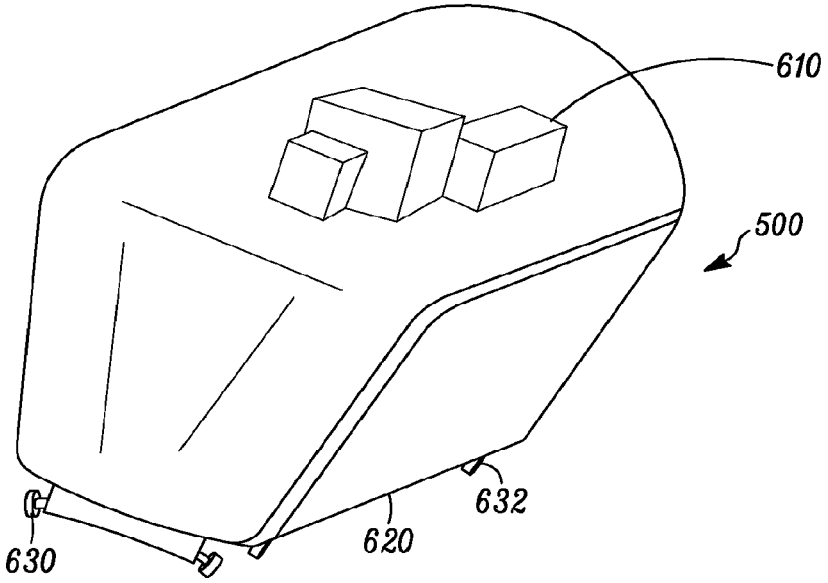
FIG. 6A is a perspective view of an encased mine neutralizing buoy, according to an example embodiment.
Figure 6B:
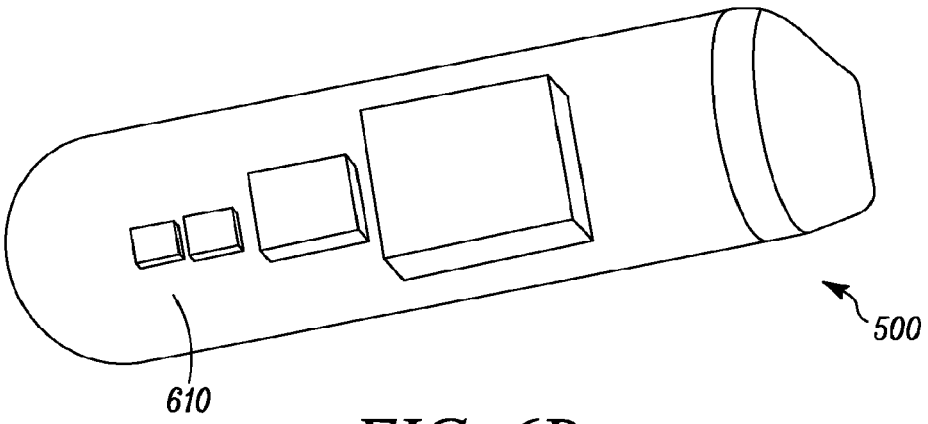
FIG. 6B is a perspective view of an encased mine neutralizing buoy, according to an example embodiment.

FIGS. 6A and 6B are perspective views of an encased mine neutralizing buoy, according to several example embodiments. Now referring to both FIG. 6A and FIG. 6B the encased mine neutralizing buoy 500 will be further detailed. The neutralizer buoy 500 includes an external cover 610 and a fairing 620. The fairing 620 includes several sets of wheels 630, 632 which engage the channels and the rails, such as rails 311 and 312, of the rail system 300. The buoy incorporates a communication system, a tracking system, a global positioning system (GPS), a compass and a processor. The neutralizer buoy is capable of remotely launching mine neutralizers 800 (shown in FIGS. 1, 8D, 8E and 10A) using a radio link for operator control. The operator is typically stationed at the remote control station 110 (see FIG. 1).

Figure 7:
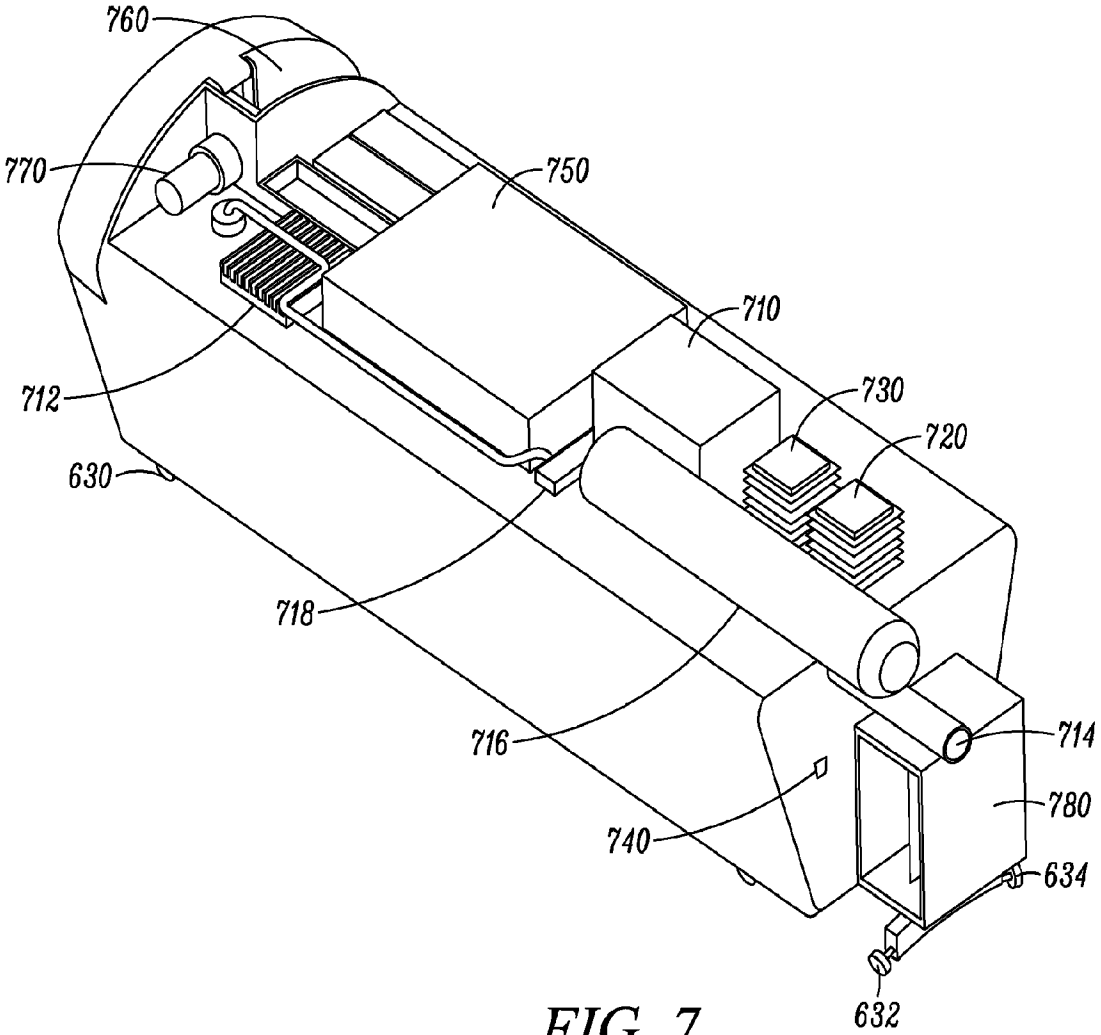
FIG. 7 is a perspective view of a mine neutralizing buoy with a cover removed to show some of the components of the buoy, according to an example embodiment.

FIG. 7 is a perspective view of a mine neutralizing buoy with a cover 610 removed to show some of the components of the neutralizer buoy 500, according to an example embodiment. The neutralizing buoy 500 includes a communication system in the form of a radio 710 and an amplifier or signal booster 712 for the radio 710. In one example embodiment, the radio 710 and the amplifier or signal booster 712 are available as a Sealancet radio and Sealancet signal booster. The communication system of the neutralizing buoy 500 also includes an antenna mast 714. The antenna mast 714 is deployed pneumatically. An air tank 716 is used to provide air to the antenna mast 714. An air valve 718 is controlled to move compressed air from the air tank 716 to the antenna mast 714. The antenna mast 714, in one embodiment, is a three-piece telescoping unit that extends approximately 12 feet above the surface of the sea or water. The antenna mast 714 is an antenna that can facilitate radio communications between the neutralizing buoy 500 and the remote control station 110. Communications include the location of the neutralizing buoy 500 as well as a visual depiction of a mine neutralizer 800 and route to a target. Other communications include signals from sensors associated with the neutralizing buoy 500. The neutralizing buoy 500 includes a GPS receiver and a network switch depicted by a PC stack 720. The neutralizing buoy 500 also includes a PC stack 730 for a set of neutralizer tracking hydrophones sensors associated with the buoy. Also shown in FIG. 7 is the heading sensor as depicted by reference 740 which works in concert with the GPS to assert the location and direction of the buoy. Neutralizing buoy 500 also includes a controller 750 which is essentially a processor or microcontroller which is used to receive commands from the remote control station 110 and implement the commands as well as to relay information over the communications channel discussed above to the deployed neutralizing device 800. The neutralizing body 500 includes batteries 760 which are used to power up the various components associated with the neutralizing buoy 500. The neutralizing buoy 500 also includes door actuator 770 which is used to actuate a door associated with the neutralizing buoy. The neutralizing buoy also includes a card rack 780 that includes a fiber-optic card which is used to communicate between the neutralizing buoy 500 deployed neutralizing device 800.

Figure 8A:
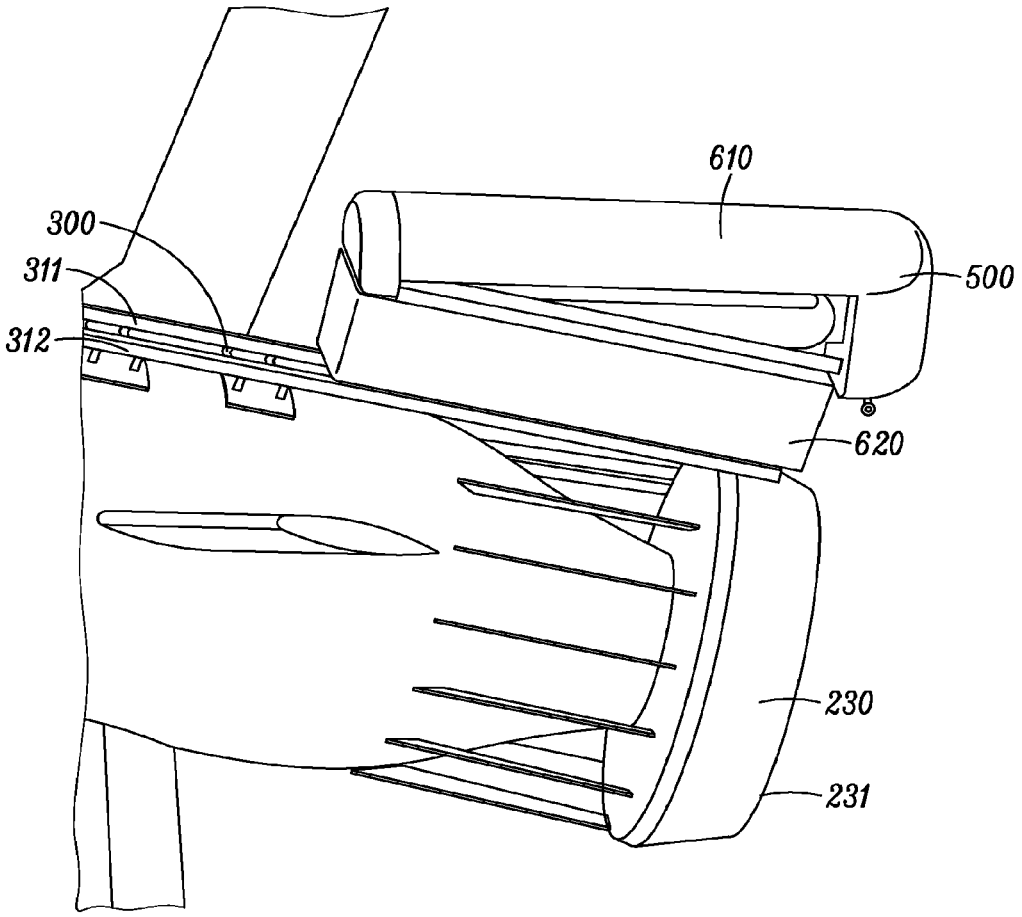
FIG. 8A is a perspective view of an encased mine neutralizing buoy being deployed from a remote multi mission vehicle (RMMV) loaded with a plurality of mine neutralizer buoys, according to an example embodiment.

FIG. 8A is a perspective view of an encased mine neutralizing buoy 500 being deployed from a remote multi mission vehicle (RMMV) 200 loaded with a plurality of mine neutralizer buoys, according to an example embodiment. The remote multi mission vehicle 200 releases or deploys the mine neutralizing buoy 500 and response to a command received from the remote control station 110 via the communication channel between the remote control station and the remote multi mission vehicle 200. The command would be received by the controller 750 (see FIG. 7). The controller 750 would control the actuator mechanism for a hook or latch 530 to move from a latched position to an unmatched position for a particular neutralizing buoy 500 on the rail system 300. As shown, water pressure will force the buoy to travel toward the stern of the remote multi mission vehicle 200 along the rails 311, 312 so that releases at or beyond the shroud 230 near the stern.

Figure 8B:
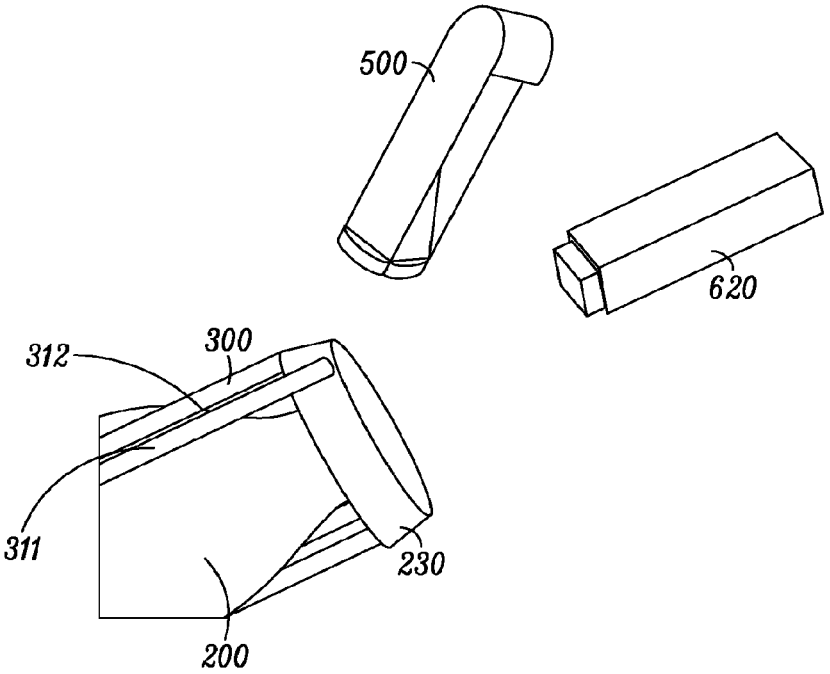
FIG. 8B is a perspective view of an encased mine neutralizing buoy being deployed from a remote multi mission vehicle (RMMV) as a door to the mine neutralizer buoy is removed during deployment, according to an example embodiment.
Figure 8C:
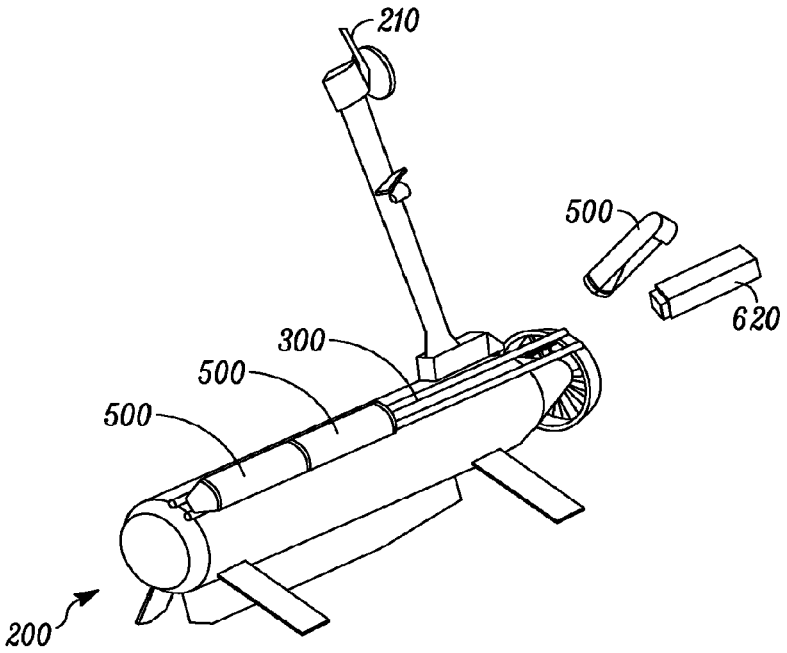
FIG. 8C is a perspective view of an encased mine neutralizing buoy being deployed from a remote multi mission vehicle (RMMV) as a door to the mine neutralizer buoy is removed during deployment, according to an example embodiment.

FIGS. 8B and 8C are perspective views of an encased mine neutralizing buoy being deployed from a remote multi mission vehicle (RMMV) as the fairing 620 to the mine neutralizer buoy is shed during deployment, according to an example embodiment. The fairing 620 is held to the rail or rails 311, 312 and not the buoy 500. Once the buoy is clear of the rails the fairing 620 separates from the neutralizing buoy 500. The fairing 620 is disposable and sinks to the bottom of the ocean or sea or other body of water. FIG. 8A shows the buoy 500 shortly before it clears the rails. FIGS. 8B and 8C show the neutralizer buoy 500 after it's clear the rails and the fairing 620 is being shed.

Figure 8D:
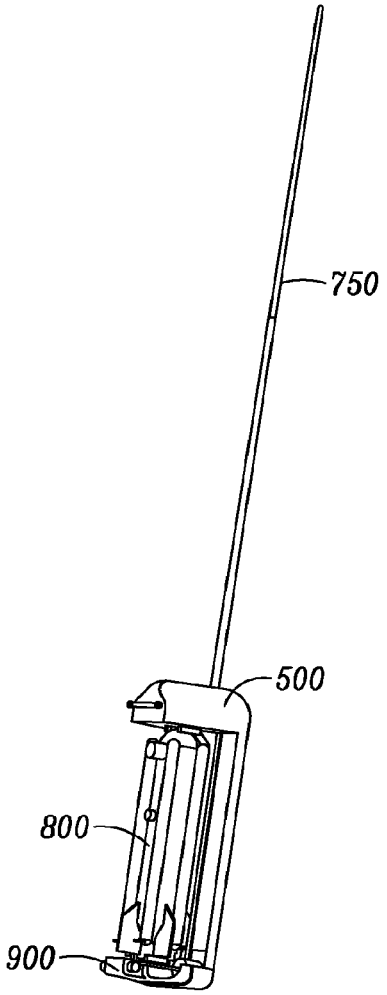
FIG. 8D is a perspective view of a mine neutralizing buoy being deployed from a remote multi mission vehicle (RMMV) after a door to the mine neutralizer buoy is removed and the antenna is deployed, according to an example embodiment.
Figure 8E:
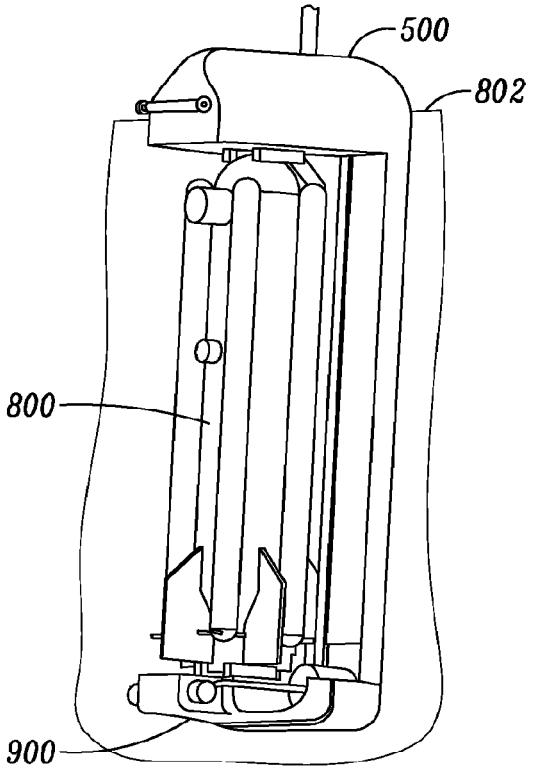
FIG. 8E is a perspective view of an mine neutralizing buoy holding the mine neutralizing swim device after being deployed from a remote multi mission vehicle (RMMV), according to an example embodiment.

FIGS. 8D and 8E is a perspective view of a mine neutralizing buoy 500 after being deployed from a remote multi mission vehicle (RMMV) and a fairing 620 of the mine neutralizer buoy is removed and the antenna 714 is deployed, according to an example embodiment. After the buoy 500 clears the rails and after the fairing 620 has been shed, the valve 718 to the compressed air tank 716 is opened. In one embodiment of the invention, the controller 750 opens the valve 718 after a predetermined amount of time lapses after release of the buoy 500. The antenna 714 is deployed pneumatically. The buoy 500 floats to the surface 802 of the body of water. The buoy 500 floats in a vertical orientation to maximize the stability of the antenna 714. The antenna mast 714 and the associated antenna can then be used to communicate information between the buoy 500 and the remote control station 110. As can be seen, the mine neutralizing buoy 500 continues to hold the mine neutralizing device 800 after being deployed from a remote multi mission vehicle (RMMV) and floating to the surface of the water, according to an example embodiment. The mine neutralizing device 800 is held between the frame of the buoy 500 and a hinged door 900 which is attached to the frame of the buoy.

Figure 9A:
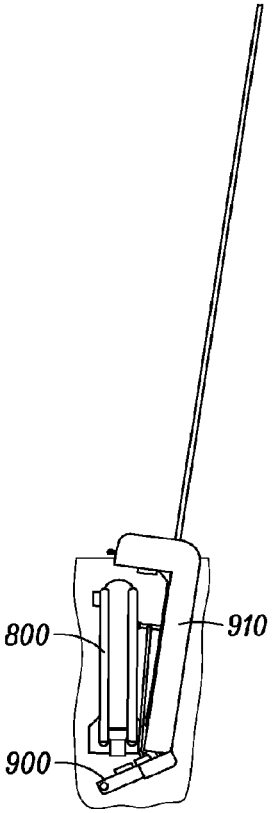
FIG. 9A is a perspective view of a mine neutralizing swim device as it is being deployed from the mine neutralizer buoy, according to an example embodiment.
Figure 9B:
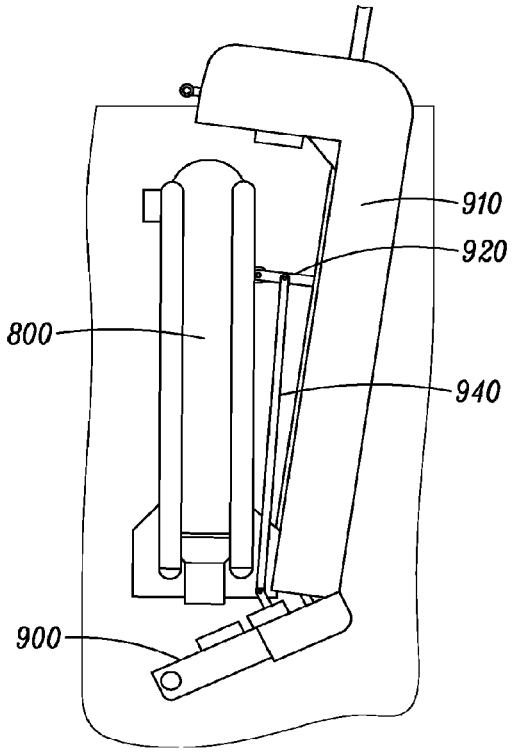
FIG. 9B is a perspective view of a mine neutralizing swim device as it is being deployed from the mine neutralizer buoy, according to an example embodiment.
Figure 9C:
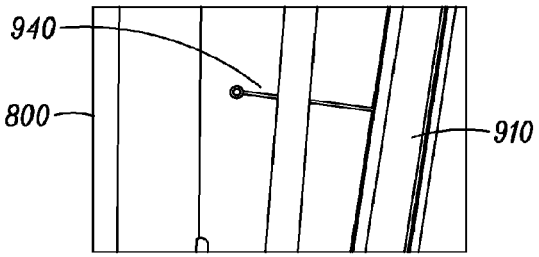
FIG. 9C is a close up perspective view of a mine neutralizing swim device having a lanyard attached thereto as it is being deployed from the mine neutralizer buoy, according to an example embodiment.

FIGS. 9A, 9B, 9C are perspective views of a mine neutralizing device 800 being deployed from the mine neutralizer buoy 500, according to an example embodiment. The mine neutralizer buoy 500 includes a door 900 which is pivotally attached to the frame 910 of the neutralizer buoy 500. The neutralizer is released in response to the signal over the communications system or radio link with the remote control station 110. The neutralizer buoy 500 also includes a four bar linkage 920 that pushes the neutralizer device 800 away from the frame 910 and the door 900 of the neutralizer buoy 500. FIG. 9C shows a close up perspective view of a mine neutralizing swim device 800 being deployed from the mine neutralizer buoy 500, according to an example embodiment. A lanyard 940 is attached between the mine neutralizer buoy 500 and the neutralizer device 800. One end of the lanyard 940 is tied to the frame 910 of the mine neutralizer buoy 500. The other end of the lanyard 940 is tied to an arming pin associated with the neutralizer device 800. In one embodiment, the neutralizer device is essentially a torpedo that swims to a target and destroys it. In this particular instance, the target is an undersea mine, such as undersea mine 122 or 120. The door 900 is positioned near the stern of the mine neutralizer device 800. The frame 910 and more specifically the top of the frame 910 holds the bow of the mine neutralizer 800. As the door 900 drops, the bow or front portion of the mine neutralizer tips toward a downward direction. The mine neutralizer 800 is also attached to the buoy 500 via an optical cable or fiber optic cable so that an operator within the remote control station 110 can get visual feedback of the neutralizer 800 as it heads toward the target mine 120, 122. Thus, as the mine neutralizer 800 is deployed the lanyard 940 polls an arming pin to arm the device and an operator can steer the device toward the target using optical feedback passed through an optical link and to the communications equipment aboard the buoy 500 and to the remote control station 110.

Figure 10A:
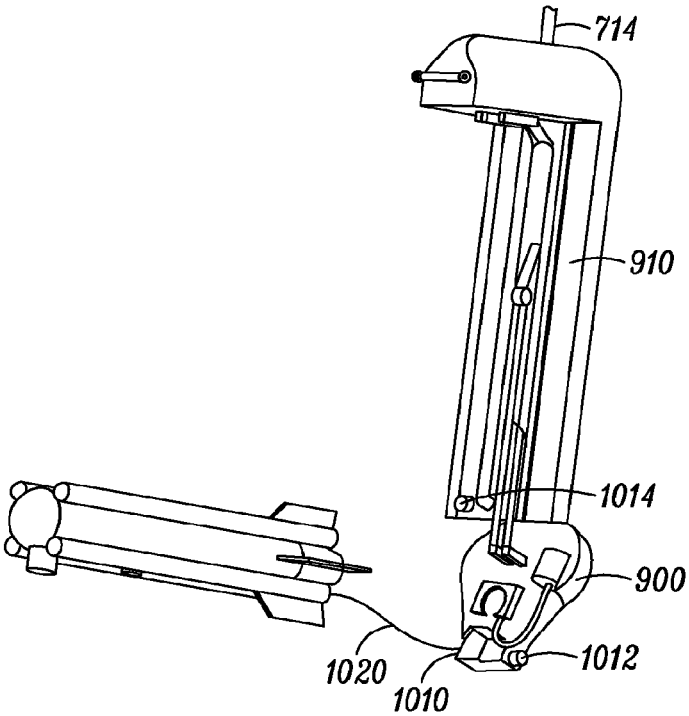
FIG. 10A is a perspective view of a mine neutralizer buoy after the mine neutralizing swim device has been deployed, according to an example embodiment.
Figure 10B:
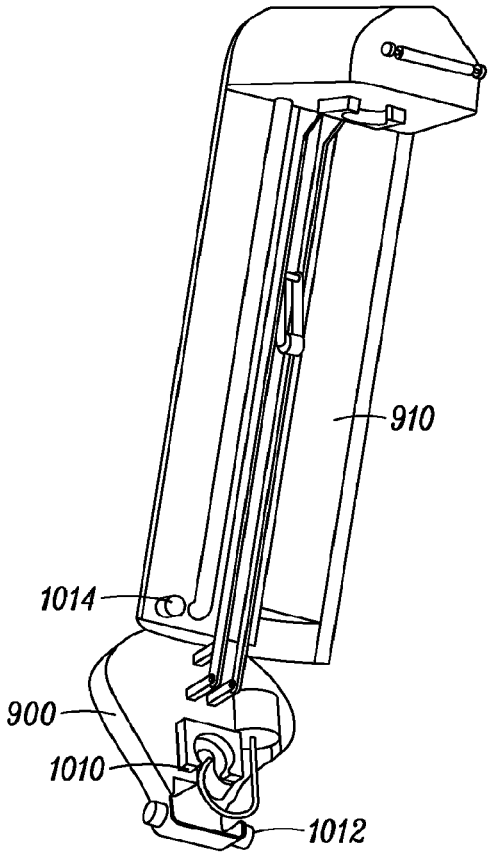
FIG. 10B is a perspective view of a mine neutralizer buoy after the mine neutralizing swim device has been deployed, according to an example embodiment.

FIGS. 10A and 10B are perspective views of a mine neutralizer buoy 500 after the mine neutralizing swim device 800 has been deployed, according to an example embodiment. As shown, the buoy 500 also includes a set of sensors or hydrophones 1010, 1012, 1014. The neutralizing device 800 produces a sound upon deployment from the buoy 500. The sound can be detected by the hydrophones 1010, 1012 and 1014. Three hydrophones are used in order to detect the location of the neutralizing device 800 with respect to the buoy 500. Given the position of the buoy 500 at the time of deployment and knowing the position of the undersea mine, such as mine 122 (see FIG. 1), the buoy can be programmed to take a specific course to the target. The hydrophones 1010, 1012, 1014 can be used to determine whether the neutralizing device 800 is on course or off course. The hydrophones provide feedback as to the course of the neutralizing device 800. The neutralizing device 800 can also be steered from the remote control station 110. In other words the hydrophones provide feedback regarding course and direction toward the target and the visual feedback from the neutralizer device 800 is used to fine tune or steer the neutralizer at the target once it becomes visually acquired. The fiber-optic cable 1020 is shown as a line that connects the buoy 500 to the neutralizer 800. The fiber-optic cable 1020 carries commands to the neutralizer 800. The fiber-optic cable 1020 also provides visual feedback to the operator in the remote control station 110.

Figure 11:
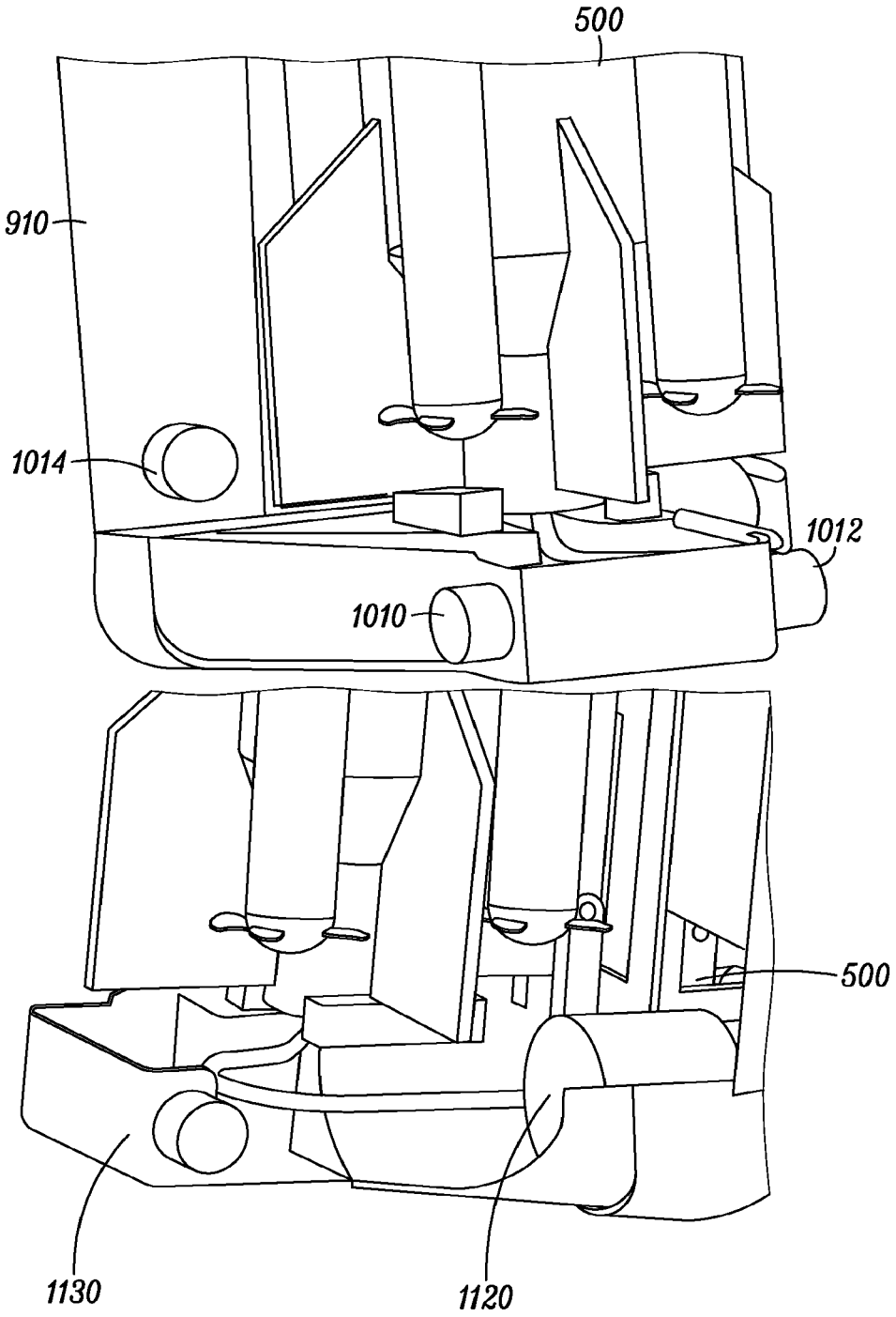
FIG. 11 is a perspective view of a fiber optic spool for communicatively coupling the mine neutralizer buoy and the mine neutralizing swim device as it is being directed to an undersea mine, according to an example embodiment.

FIG. 11 is a perspective view of a fiber optic spool 1120 for holding fiber-optic cable 1020 which is used to communicatively couple the mine neutralizer buoy 500 and the mine neutralizing swim device 800 as it is being directed to an undersea mine, such as mine 122, according to an example embodiment. The fiber optic spool 1120 controllably feeds out the fiber-optic cable 1020 as the mine neutralizer 800 swims toward its target. The fiber-optic spool 1120 is positioned so as to minimize the risk of the fiber-optic cable 1020 getting caught or tangled in the buoy 500. If the fiber-optic cable 1020 is severed communications with the neutralizer device 800 is also severed. This could render the mine neutralizer 800 ineffective. The fiber-optic cable 1020 is also protected by a shield 1130. FIG. 11 also shows a close-up of the hydrophones 1010, 1012, 1014. The hydrophones 1010, 1012, 1014, in one embodiment, are provided with a built-in preamp. The signals from the hydrophones 1010, 1012, 1014 are sent to the PC stack 730 (see FIG. 7). At the PC stack 730 the signals from the hydrophones are converted into meaningful information and sent via the communications package to the remote control station 110.

Figure 12:
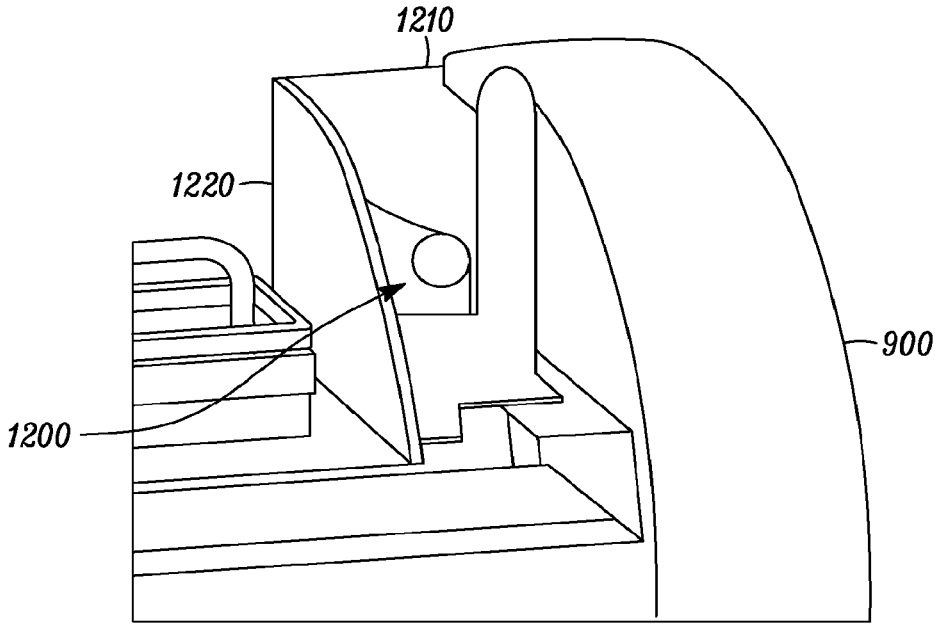
FIG. 12 is a side perspective view of a mechanism for opening the door of the neutralizer buoy, according to an example embodiment.

FIG. 12 is a side perspective view of a mechanism 1200 for opening the door 900 of the neutralizer buoy 500, according to an example embodiment. The mechanism 1200 includes a gear 1210 and a motor 1220 to drive the gear 1210. The motor 1220 acts in response to signals from the controller 732 open the door and release the neutralizing device 800.

Figure 13:
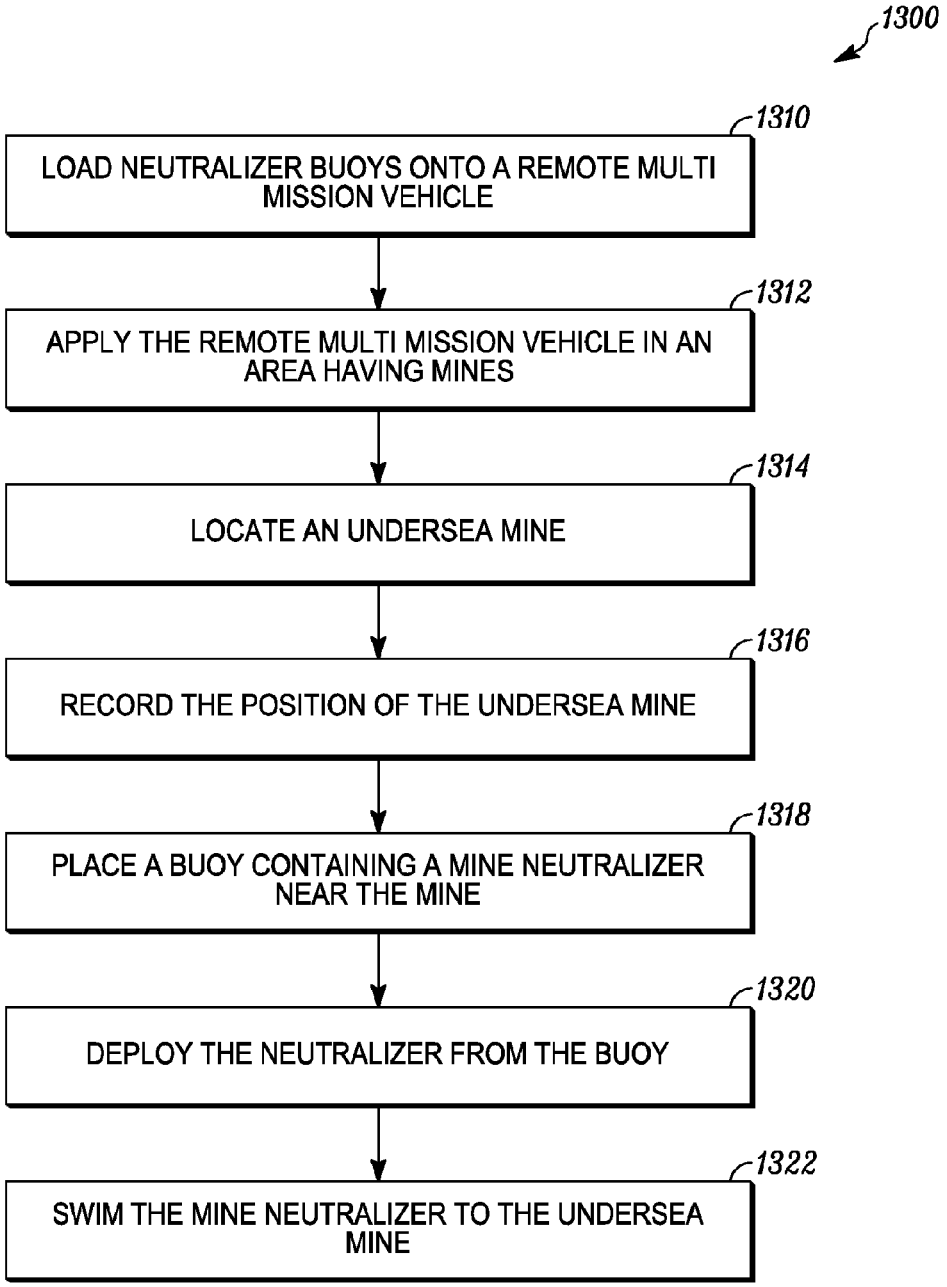
FIG. 13 is a flow chart of a method for neutralizing undersea mines, according to an example embodiment.

FIG. 13 is a flow chart of a method 1300 for neutralizing undersea mines, according to an example embodiment. The method 1300 for neutralizing undersea mines includes loading neutralizer buoys onto a remote multi mission vehicle 1310, and applying the remote multi mission vehicle in an area having mines 1312. The method also includes locating an undersea mine 1314, and recording it's position 1316. The method also includes placing a buoy containing a mine neutralizer near the mine 1318, deploying the neutralizer from the buoy 1320, and swimming the mine neutralizer to the undersea mine 1322. In one embodiment, the neutralizer 800 explodes to destroy the undersea mine. In one embodiment, a remote multi-mission vehicle is remotely controlled in the water from a remote location. The remote multi-mission vehicle carries several mine neutralizing buoys. The remote multi-mission vehicle locates the mine and marks the location. The location is sent to a remote control station. At about the same time, a mine neutralizing buoy is deployed from the remote neutralizing vehicle. The buoy floats to the surface. It too has an antenna and is capable of floating indefinitely, determining its location, and being controlled from a remote control station. When there is a plurality of undersea mines, a plurality of buoys are deployed over time. The remote multi-mission vehicle can be removed from the area so that it can be recovered and reused. The remote control station can then deploy one or more neutralizing devices from the mine neutralizing buoys to neutralize the undersea mines. This can all be done remotely and stealthily.

Figure 14:
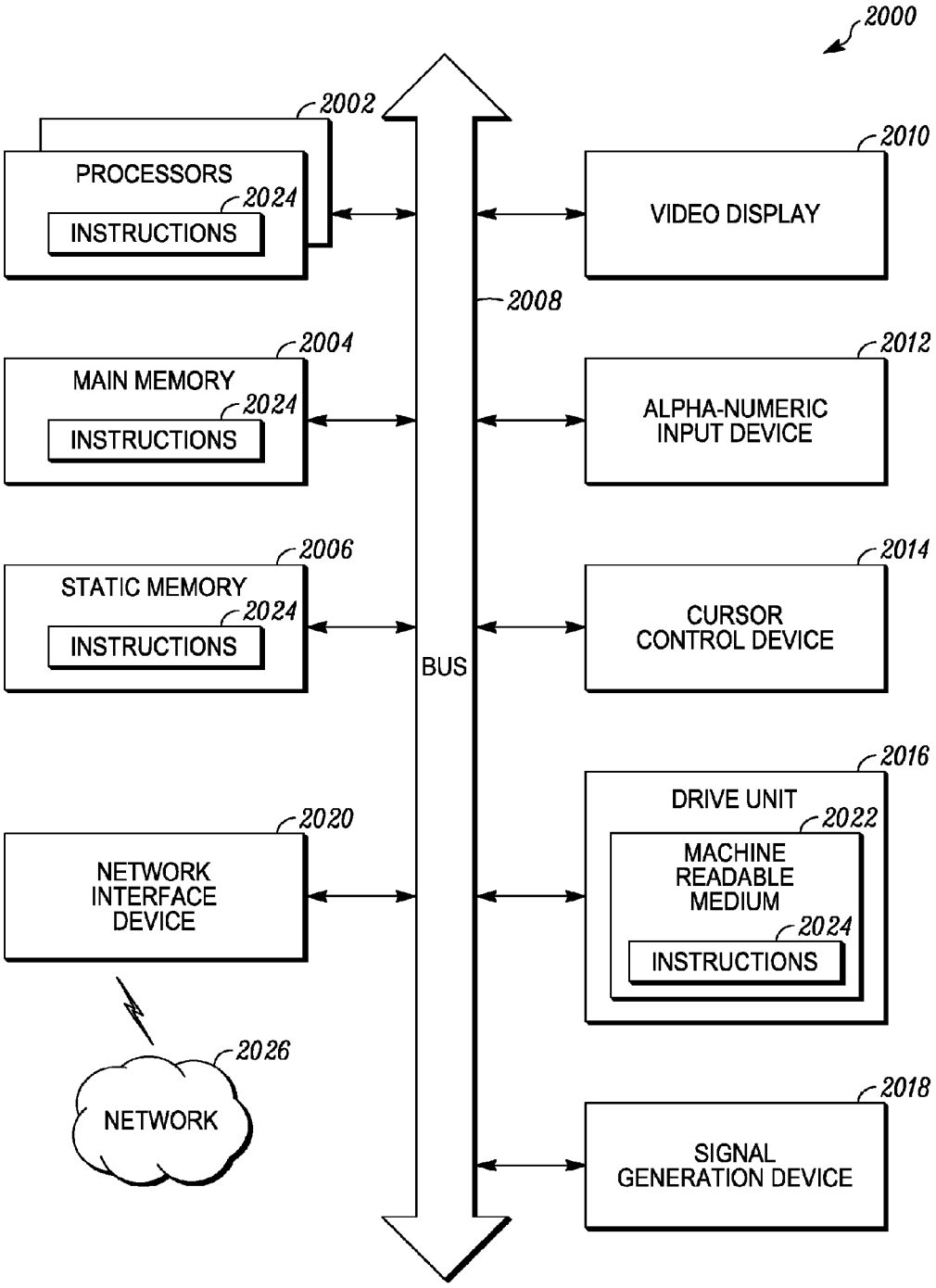
FIG. 14 shows a diagrammatic representation of a computer system, within which a set of instructions for causing the machine to perform any one or more of the methodologies discussed herein can be executed.

FIG. 14 shows a diagrammatic representation of a computer system 2000, within which a set of instructions for causing the machine to perform any one or more of the methodologies discussed herein can be executed. In various example embodiments, the machine operates as a standalone device or can be connected (e.g., networked) to other machines. In a networked deployment, the machine can operate in the capacity of a server or a client machine in a server-client network environment, or as a peer machine in a peer-to-peer (or distributed) network environment. The machine can be a personal computer (PC), a tablet PC, a set-top box (STB), a Personal Digital Assistant (PDA), a cellular telephone, a portable music player (e.g., a portable hard drive audio device such as a Moving Picture Experts Group Audio Layer 3 (MP3) player, a web appliance, a network router, a switch, a bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 2000 includes a processor or multiple processors 2002 (e.g., a central processing unit (CPU), a graphics processing unit (GPU), arithmetic logic unit or all), and a main memory 2004 and a static memory 2006, which communicate with each other via a bus 2008. The computer system 2000 can further include a video display unit 2010 (e.g., a liquid crystal displays (LCD) or a cathode ray tube (CRT)). The computer system 2000 also includes an alphanumeric input device 2012 (e.g., a keyboard), a cursor control device 2014 (e.g., a mouse), a disk drive unit 2016, a signal generation device 2018 (e.g., a speaker) and a network interface device 2020.

The disk drive unit 2016 includes a computer-readable medium 2022 on which is stored one or more sets of instructions and data structures (e.g., instructions 2024) embodying or utilized by any one or more of the methodologies or functions described herein. The instructions 2024 can also reside, completely or at least partially, within the main memory 2004 and/or within the processors 2002 during execution thereof by the computer system 2000. The main memory 2004 and the processors 2002 also constitute machine-readable media.

The instructions 2024 can further be transmitted or received over a network 2026 via the network interface device 2020 utilizing any one of a number of well-known transfer protocols (e.g., Hyper Text Transfer Protocol (HTTP), CAN, Serial, or Modbus).

While the computer-readable medium 2022 is shown in an example embodiment to be a single medium, the term "computer-readable medium" should be taken to include a single medium or multiple media (e.g., a centralized or distributed database, and/or associated caches and servers) that store the one or more sets of instructions and provide the instructions in a computer readable form. The term "computer-readable medium" shall also be taken to include any medium that is capable of storing, encoding, or carrying a set of instructions for execution by the machine and that causes the machine to perform any one or more of the methodologies of the present application, or that is capable of storing, encoding, or carrying data structures utilized by or associated with such a set of instructions. The term "computer-readable medium" shall accordingly be taken to include, but not be limited to, solid-state memories, optical and magnetic media, tangible forms and signals that can be read or sensed by a computer. Such media can also include, without limitation, hard disks, floppy disks, flash memory cards, digital video disks, random access memory (RAMs), read only memory (ROMs), and the like.

When a computerized method, discussed above, is programmed into a memory of a general purpose computer, the computer and instructions form a special purpose machine. The instructions, when programmed into a memory of a general purpose computer, are in the form of a non transitory set of instructions.

The example embodiments described herein can be implemented in an operating environment comprising computer-executable instructions (e.g., software) installed on a computer, in hardware, or in a combination of software and hardware. Modules as used herein can be hardware or hardware including circuitry to execute instructions. The computer-executable instructions can be written in a computer programming language or can be embodied in firmware logic. If written in a programming language conforming to a recognized standard, such instructions can be executed on a variety of hardware platforms and for interfaces to a variety of operating systems. Although not limited thereto, computer software programs for implementing the present method(s) can be written in any number of suitable programming languages such as, for example, Hyper text Markup Language (HTML), Dynamic HTML, Extensible Markup Language (XML), Extensible Stylesheet Language (XSL), Document Style Semantics and Specification Language (DSSSL), Cascading Style Sheets (CSS), Synchronized Multimedia Integration Language (SMIL), Wireless Markup Language (WML), Java™, Jini™, C, C++, Perl, UNIX Shell, Visual Basic or Visual Basic Script, Virtual Reality Markup Language (VRML), ColdFusion™ or other compilers, assemblers, interpreters or other computer languages or platforms.

Figure 15:
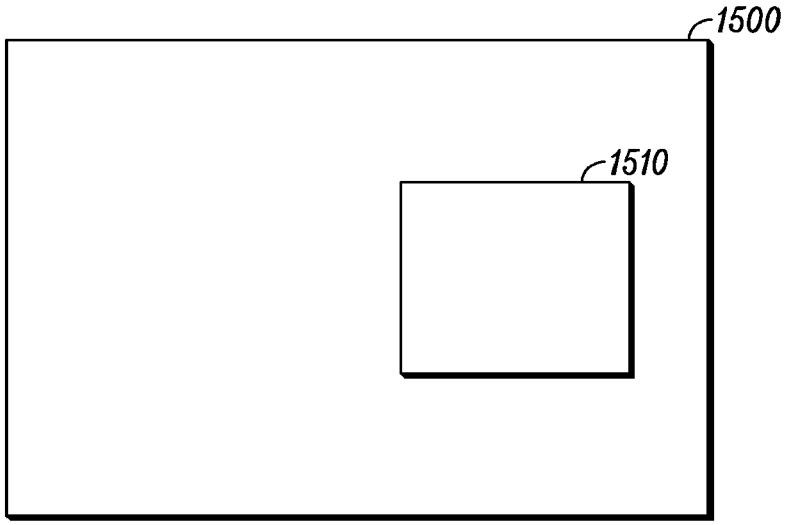
FIG. 15 is a schematic drawing of a machine readable medium that includes an instruction set, according to an example embodiment.

FIG. 15 is a schematic drawing of a machine readable medium 1200 that includes an instruction set 1210, according to an example embodiment. The machine-readable medium 1200 that provides instructions 1210 that, when executed by a machine, cause the machine to perform operations associated with controlling the various components of the mind neutralizing system 100. The machine-readable medium can also be used to instruct the controller 750 of the buoy 500 or at the controller of the mine neutralizer 800. The instructions 1210 can also use the outputs from the plurality of buoys 500 to track or locate mine neutralizers 800 or other vessels. It should also be pointed out that the above technology may be used for other than military purposes, such as for research and the like.

Figure 16:
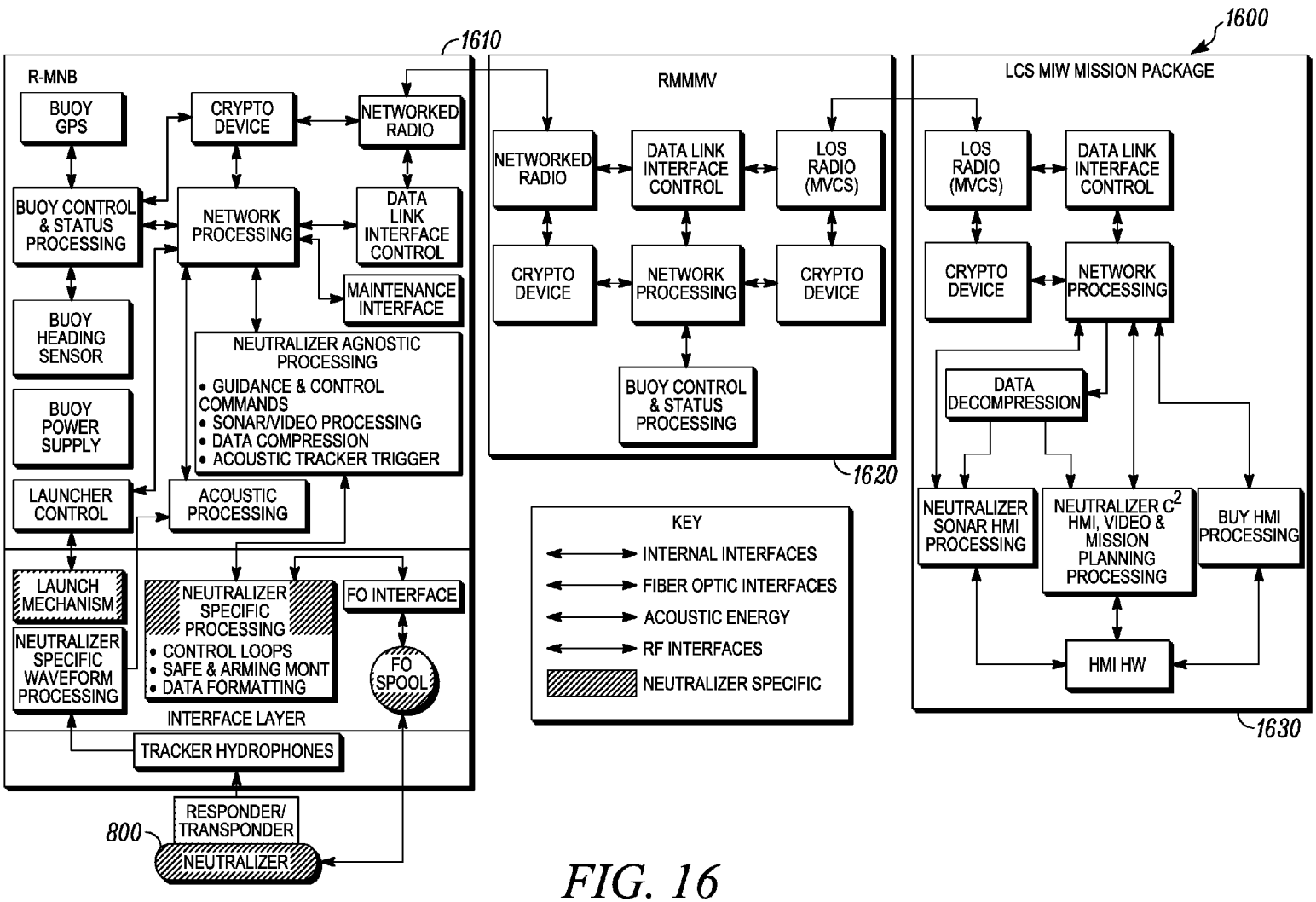
FIG. 16 is a schematic drawing of a computing system for the mine neutralizing system that includes a plurality of computing devices, according to an example embodiment.

FIG. 16 is a schematic drawing of a computing system 1600 for the mine neutralizing system 100 (shown in FIG. 1) that includes a plurality of computing devices, according to an example embodiment. The computing system 1600 includes at least one computing device on board the remote multi mission vehicle 200, at least one computing device associated with the remote control system 110. In some embodiments, the buoy 500 includes at least one computing device and the mine neutralizer also includes at least one computing device. A computing device can be an entire computer, a networked computer connected to other computing devices, or a device including a microcontroller or microprocessor. Such computing devices are programmed with software to form the various modules shown in the computing system 1600. The various modules can be formed from hardware, software, or a combination of hardware and software. Software is an instruction set to cause a processor to perform various tasks. When a processor is provided with an instruction set it becomes a specialized machine. As shown in FIG. 16, the various modules are associated with various components of the mine neutralizing system 100, as depicted by boxes surrounding certain sets of modules. The modules within 1610 are the modules associated with the buoy 500 and the mine neutralizer 800. The modules within 1620 are associated with the remote multi mission vehicle 200, and the modules within 1630 are associated with the remote control station 110. The lines between the various modules show the flow of data, commands and other information throughout the system 1600.

A mine neutralizing system includes a buoy. The buoy includes a mine neutralizing device capable of swimming to an undersea mine to neutralize it. A method for neutralizing undersea mines includes locating an undersea mine, placing a buoy containing a mine neutralizer near the mine, and swimming the mine neutralizer to the undersea mine where it explodes to destroy the mine. In one embodiment, a remote multi-mission vehicle is remotely controlled in the water from a remote location. The remote multi-mission vehicle carries several mine neutralizing buoys. The remote multi-mission vehicle locates the mine and marks its location. The location is sent to a remote control station. At about the same time, a mine neutralizing buoy is deployed from the remote neutralizing vehicle. The buoy floats to the surface. It too has an antenna and is capable of floating indefinitely, determining its location, and being controlled from a remote control station. When there is a plurality of undersea mines, a plurality of buoys are deployed over time. The remote multi-mission vehicle can be removed from the area so that it can be recovered and reused. The remote control station can then deploy one or more neutralizing devices from the mine neutralizing buoys to neutralize the undersea mines. This can all be done remotely and stealthily.

The present disclosure refers to instructions that are received at a memory system. Instructions can include an operational command, e.g., read, write, erase, refresh, etc., an address at which an operational command should be performed, and the data, if any, associated with a command. The instructions can also include error correction data.

This has been a detailed description of some exemplary embodiments of the invention(s) contained within the disclosed subject matter. Such invention(s) may be referred to, individually and/or collectively, herein by the term "invention" merely for convenience and without intending to limit the scope of this application to any single invention or inventive concept if more than one is in fact disclosed. The detailed description refers to the accompanying drawings that form a part hereof and which shows by way of illustration, but not of limitation, some specific embodiments of the invention, including a preferred embodiment. These embodiments are described in sufficient detail to enable those of ordinary skill in the art to understand and implement the inventive subject matter. Other embodiments may be utilized and changes may be made without departing from the scope of the inventive subject matter. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A method for neutralizing an undersea mine comprising:

locating an undersea mine;

placing a buoy containing a mine neutralizer near the mine; and deploying the mine neutralizer from the buoy, including removing an arming pin as the mine neutralizer is deployed; and directing the mine neutralizer to the undersea mine to neutralize the undersea mine.

2. The method of claim 1 wherein placing a buoy containing a mine neutralizer near the mine includes moving a vehicle carrying at least one buoy to a position near the undersea mine.

3. The method of claim 2 wherein the vehicle is unmanned and controlled from a remote location.

4. The method of claim 1 wherein placing a buoy containing a mine neutralizer near the mine further comprises:

moving a unmanned vehicle carrying at least one buoy to a position near the undersea mine; and releasing the buoy containing a mine neutralizer from the unmanned vehicle, wherein moving the unmanned vehicle and releasing the buoy is controlled from a remote location.

5. The method of claim 1 wherein deploying the mine neutralizer from the buoy includes opening a door associated with the buoy and moving the mine neutralizer to a position clear of the buoy.

6. The method of claim 1 wherein directing the mine neutralizer to the undersea mine includes receiving feedback from the mine neutralizer as the mine neutralizer is moved to the mine.

7. The method of claim 6 wherein receiving feedback from the mine neutralizer includes receiving positional data from the mine neutralizer.

8. The method of claim 6 wherein receiving feedback from the mine neutralizer includes receiving visual data from the mine neutralizer.

9. The method of claim 6 wherein receiving feedback from the mine neutralizer includes receiving visual data from the mine neutralizer, the mine neutralizer being connected to the buoy via an optical cable.

* * * * *